US011399619B2

(12) United States Patent
Buffinton

(10) Patent No.: US 11,399,619 B2
(45) Date of Patent: Aug. 2, 2022

(54) BACKPACK

(71) Applicant: Deuter Sport GmbH, Gersthofen (DE)

(72) Inventor: Stephen Buffinton, Augsburg (DE)

(73) Assignee: Deuter Sport GmbH, Gersthofen (DE)

( * ) Notice: Subject to any disclaimer, the term of this patent is extended or adjusted under 35 U.S.C. 154(b) by 44 days.

(21) Appl. No.: 16/004,334

(22) Filed: Jun. 8, 2018

(65) Prior Publication Data

US 2018/0352939 A1 Dec. 13, 2018

(30) Foreign Application Priority Data

Jun. 9, 2017 (DE) ..... 102017112759.3

(51) Int. Cl.

| | |
|---|---|
| ***A45F 3/08*** | (2006.01) |
| ***A45F 3/12*** | (2006.01) |
| *A45F 3/04* | (2006.01) |

(52) U.S. Cl.

CPC ..... *A45F 3/08* (2013.01); *A45F 3/12* (2013.01); *A45F 3/047* (2013.01); *A45F 2003/122* (2013.01); *A45F 2003/125* (2013.01); *A45F 2003/127* (2013.01)

(58) Field of Classification Search

CPC ..... A45F 2003/122; A45F 2003/125; A45F 2003/127; A45F 3/08; A45F 3/12; A45F 3/047; A45F 3/10; A45F 2004/006; A45F 3/00; A45F 3/14

USPC ..... 224/628

See application file for complete search history.

(56) References Cited

U.S. PATENT DOCUMENTS

| | | | | |
|---|---|---|---|---|
| 4,860,936 | A * | 8/1989 | Lowe | A45F 3/047 224/632 |
| 5,361,955 | A * | 11/1994 | Gregory | A45F 3/04 224/630 |
| 5,704,530 | A * | 1/1998 | Scherer | A45F 3/047 224/632 |
| 8,505,791 | B2 * | 8/2013 | Fidrych | A45F 3/047 224/197 |
| 9,591,910 | B2 | 3/2017 | Kemp et al. | |
| 2011/0011903 | A1 * | 1/2011 | Buffinton | A45F 3/08 224/191 |
| 2012/0012629 | A1 | 1/2012 | Buffinton | |
| 2013/0206805 | A1 | 8/2013 | Kim et al. | |

(Continued)

FOREIGN PATENT DOCUMENTS

| | | | |
|---|---|---|---|
| EP | 2407050 | A2 | 4/2011 |
| EP | 2965653 | A1 | 1/2016 |
| WO | 2015119877 | A1 | 8/2015 |

*Primary Examiner* — Nathan J Newhouse
*Assistant Examiner* — M. T. T.
(74) *Attorney, Agent, or Firm* — Bradley Arant Boult Cummings; Timothy L. Capria; Alexandra C. Lynn

(57) ABSTRACT

The invention relates to a backpack (10) having a stowage space (18), which on its side facing the back of a user of the backpack is delimited by a back part (20). The backpack (10) includes a net element (12) and a frame arrangement (22), which for tensioning the net element (12) is designed in such a way that an intermediate space (24) is formed between the back part (20) and the net element (12) when the net element (12) is tensioned. The backpack (10) has two shoulder straps (14, 16) for carrying the backpack (10) on the user's back. The shoulder straps (14, 16) have end areas (42, 44) that cross the intermediate space (24) and are fastened to the back part (20).

20 Claims, 5 Drawing Sheets

(56) References Cited

U.S. PATENT DOCUMENTS

| | | | | |
|---|---|---|---|---|
| 2016/0007720 | A1* | 1/2016 | Kemp | A45F 3/047<br>224/627 |
| 2017/0099932 | A1 | 4/2017 | Mather et al. | |

* cited by examiner

BACKPACK

This application is a nonprovisional patent application filed by applicant Deuter Sport GmbH for the invention by Stephen Buffinton, a citizen of Germany, residing in Augsburg, Germany, entitled, "Backpack." This application claims priority to German Patent Application No. 102017112759.3, filed on Jun. 9, 2017.

TECHNICAL FIELD

The invention relates to a backpack having a stowage space, which on its side facing the back of a user of the backpack is delimited by a back part. The backpack includes a net element and a frame arrangement that is designed for tensioning the net element. An intermediate space is formed between the back part and the net element when the net element is tensioned. Two shoulder straps are provided for carrying the backpack on the user's back.

This type of backpack is described in EP 2 407 050 A2, for example. In the cited document, the shoulder straps are fastened to an upper edge of the net element.

When the backpack is loaded, i.e., when objects being carried by the user of the backpack are present in the stowage space, a tensile load on the net element occurs with this type of fastening of the shoulder straps. This may result in undesirable deformation of the net element.

The net element and the frame arrangement are generally intended to ensure that when the net element is tensioned by means of the frame arrangement, the user's back does not rest against the back part of the backpack. The net element in cooperation with the frame arrangement thus provides for entry of air to the user's back, i.e., ventilation which is pleasant for the user, while carrying the backpack. However, deformation of the net element may impair the ventilation of the user's back.

BRIEF SUMMARY

The object of the present invention, therefore, is to provide a backpack of the type stated at the outset, in which deformation of the net element caused by the shoulder straps is avoided.

This object is achieved by a backpack having the features of patent claim 1. Advantageous embodiments with practical refinements of the invention are stated in the dependent patent claims.

The backpack according to the invention includes a stowage space, which on its side facing the back of a user of the backpack is delimited by a back part of the backpack. The backpack has a net element and a frame arrangement. The frame arrangement is designed for tensioning the net element in such a way that an intermediate space is formed between the back part and the net element when the net element is tensioned. The backpack includes two shoulder straps for carrying the backpack on the user's back. The shoulder straps have end areas that cross the intermediate space and are fastened to the back part. This ensures that no tensile load can be exerted on the net element via the shoulder straps. Deformation of the net element is thus reliably avoided.

In addition, in the fastening area of the shoulder straps this also results in a space between the back part of the backpack and the user's back. This is conducive to improved ventilation of the user's back.

The end areas of the shoulder straps, viewed in a vertical direction of the backpack, are spaced apart from an area of the backpack in which the net element and the back part converge. This is accompanied by improved carrying comfort as well as improved ventilation, i.e., ventilation of the user's back, when the user is carrying the backpack on his/her back with the shoulder straps.

The back part of the backpack preferably includes at least one first plate element and at least one retaining element. The first plate element is connected to the frame arrangement by means of the at least one retaining element. The first plate element thus provides reinforcement of the back part. The at least one retaining element ensures that the first plate element is well fixed in position in relation to the frame arrangement. As a result of this embodiment, it is possible for the end areas of the shoulder straps to be fixed in position at the level of the end areas of the shoulder straps, despite the spacing between the back part and the net element. In particular, the situation may thus be avoided that the shoulder straps move apart from one another, viewed in a transverse direction of the back part.

The first, comparatively large plate element, viewed in the vertical direction of the backpack, preferably extends from the end areas of the shoulder straps to an area in which legs of the frame arrangement that extend in the vertical direction of the backpack have a minimum distance from one another. It is thus possible to achieve on the one hand comparatively large-surface reinforcement of the back part, and on the other hand, a particularly secure attachment to the frame arrangement by means of the at least one retaining element.

The back part preferably includes the first plate element and a second plate element that is separate from the first plate element. The shoulder straps are fastened to the back part in the area of the second plate element. Due to providing the two separate plate elements in the back part of the backpack, great stability of the back part is achievable, as well as particularly robust fastening of the end areas of the shoulder straps to the back part. However, providing the two separate plate elements ensures that a certain flexibility is imparted to the back part, which in turn benefits the carrying comfort of the backpack. Furthermore, by means of the frame arrangement the back part may be easily brought into the convex or arched shape in which the intermediate space is formed between the back part and the net element.

In particular, it is provided that the two plate elements are able to move relative to one another within a range of several millimeters, wherein the second plate element, which, viewed in the vertical direction of the backpack, is comparatively narrow, overlaps the first plate element only in an upper area of the first plate element. Good localized stabilization of the back part is achievable by such overlapping of the two plate elements. Nevertheless, the back part is not overly stiff over its entire height, but, rather, only at locations where this is advantageous for fixing the end areas of the shoulder straps. This also assists in easily bringing the back part into the arched shape by means of the frame arrangement.

The end areas of the shoulder straps are preferably placed on the back part at respective attachment points that are provided between the first plate element and the second plate element. The second plate element thus overlaps with the first plate element, in particular in the upper area of the first plate element. The area of the back part in which the end areas of the shoulder straps are fastened to the back part is thus particularly resilient under load. This in turn ensures particularly secure and robust fixing of the shoulder straps to the back part.

The second plate element is preferably covered by a fabric element which is fastened to a trim part that conceals the first plate element. Localized reinforcement of the first plate element by the second plate element may thus be easily achieved. However, neither the first plate element nor the second plate element is exposed. Rather, the plate elements are hidden by the fabric element or the trim part. In addition, providing the fabric element allows the second plate element to be fastened in the upper area of the first plate element by sewing, and thus, in a particularly simple manner. The fabric element may be sewn to the trim part in order to fasten the second plate element to the first plate element. The second plate element may be fixed very securely to the first plate element in particular as the result of appropriately load-resilient seams.

The trim part that conceals the first plate element may be designed in particular in the manner of a covering which covers or hides the first plate element toward the user's back and toward the stowage space.

The at least one retaining element is preferably provided on the trim part. Secure fixing of the first plate element to the frame arrangement may be achieved in a particularly easy manner, for example via tabs, loops, or the like that are provided on the trim part.

Furthermore, it has proven to be advantageous when the trim part is designed as a fabric element that includes at least one tunnel. The at least one retaining element is thus formed by the tunnel. A particularly robust and load-resilient attachment of the first plate element to the frame arrangement may be achieved with such a tunnel or fabric tunnel.

A first such tunnel preferably passes through a first leg of the frame arrangement that extends in a vertical direction of the backpack, and a second such tunnel preferably passes through a second leg of the frame arrangement that extends in the vertical direction of the backpack. It is thus easily possible by means of the frame arrangement to impart the back part with the desired arched or concave shape in which the intermediate space between the back part and the net element is formed. In addition, it is thus possible for the legs of the frame arrangement to support the first plate element, wherein the area of the respective leg through which the tunnels pass is situated in front of the first plate element. In other words, preferably those areas of the respective leg through which the tunnel passes are thus situated between the first plate element and the user's back when the user is carrying the backpack on his/her back with the shoulder straps. The frame arrangement thus also assists in bringing the back part into the desired arched shape when the frame arrangement tensions the net element.

The back part may have a crossmember in the area of the second plate element. Such additional reinforcement of the back part is advantageous in particular when the volume of the stowage space of the backpack is fairly large, for example greater than 24 liters. The crossmember is preferably overlaid with a fabric element. The crossmember may thus be easily fixed as desired at a location on the back part provided for same.

Two passages through which the end areas of the shoulder straps are guided are preferably formed in the net element. On the one hand, movement of the shoulder straps away from one another may be limited in this way. On the other hand, a particularly large net element, viewed in the transverse direction of the back part, may also be provided which ensures the spacing between the back part and the user's back. In turn, this is conducive to good ventilation, i.e., ventilation of the user's back.

The back part may have a crossmember in a lower partial area of the frame arrangement, viewed in the vertical direction of the backpack. Reinforcement may thus also be achieved in this partial area of the back part, while still allowing the back part to be easily brought into the desired arched shape.

Additionally or alternatively, the back part may have a U-shaped bracket in the lower partial area of the frame arrangement, viewed in the vertical direction of the backpack. By use of such a bracket, the back part may be arched away from the net element as desired, also in the lower partial area of the back part, wherein in particular the bracket may produce arching in the transverse direction of the back part.

Additionally or alternatively, the back part may have a third plate element in the lower partial area of the frame arrangement, viewed in the vertical direction of the backpack. Additional localized stiffening of the back part may thus also be achieved, while at the same time, the flexibility of the back part, viewed in the vertical direction of the backpack, is maintained.

Free ends of the U-shaped bracket are preferably inserted into insert pockets which, viewed in the transverse direction of the back part, are spaced farther apart from one another than are further insert pockets into which free ends of legs of the frame arrangement are inserted. The back part may thus be brought into an arched shape in particular in the area of hip flaps or hip belts, so that a space between the back part and the net element is provided in the area of the hip flaps or hip belts which improves the ventilation of the user's back.

The back part may have a crossmember which, viewed in the vertical direction of the backpack, is situated at the level of an upper transverse web of the frame arrangement. Such a crossmember is advantageous in particular for a backpack having a particularly volume of stowage space, such as a backpack having a stowage space of at least 45 liters or at least 50 liters.

Legs of the frame arrangement that extend in a vertical direction of the backpack preferably have a minimum distance from one another in a first area. The legs in a second area that adjoins the first area have a second distance from one another that is constant or becomes increasingly larger. In addition, in a third area that likewise adjoins the first area, the legs have a distance from one another that becomes increasingly larger toward the free ends of the legs. Accordingly, the legs in the first area converge toward one another, and toward the free ends of the legs, the legs grow farther apart from one another. A high level of flexibility of the back part, and at the same time sufficient rigidity, are thus achieved.

In particular when the distance between the legs is constant in the second area, it may be provided that the shoulder straps in the second area are displaceable along the frame arrangement in the vertical direction of the backpack. The carrying comfort of the backpack may be increased by such an in particular infinite adjustment of the back length.

The features and feature combinations mentioned in the description, as well as the features and feature combinations mentioned below in the description of the figures and/or shown solely in the figures, may be used not only in the particular stated combination, but also in other combinations or alone without departing from the scope of the invention. Thus, embodiments not explicitly shown or explained in the figures, but which follow and are producible from the described embodiments via separate feature combinations, are thus regarded as encompassed and disclosed by the invention.

Further advantages, features, and particulars of the invention result from the claims, the following description of preferred embodiments, and with reference to the drawings, which show the following:

DETAILED DESCRIPTION

Figure 1:
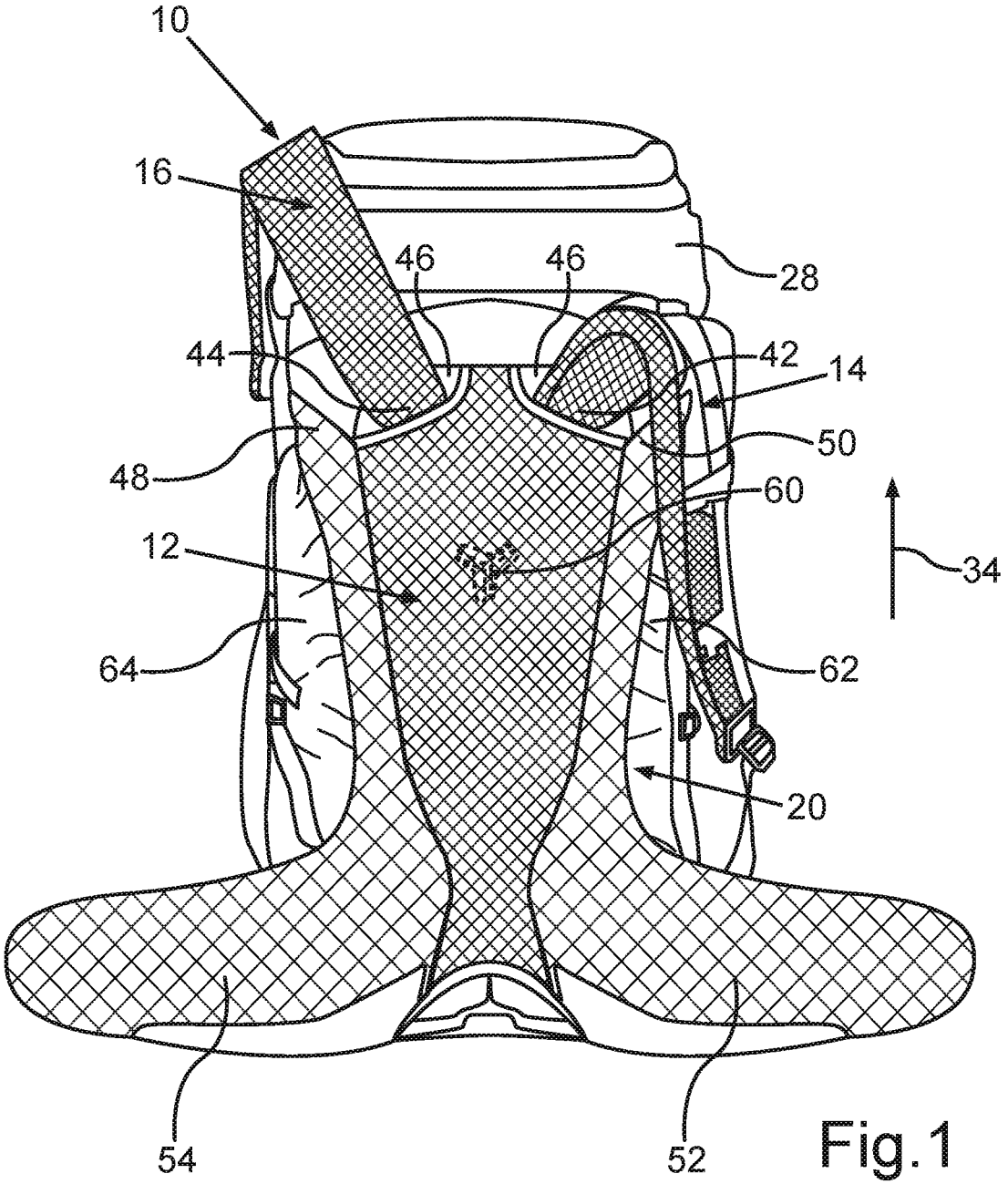
FIG. 1 shows a rear view of a backpack, which on its side facing a user of the backpack has a net element, wherein a frame arrangement for tensioning the net element is provided, and wherein end areas of shoulder straps of the backpack are fastened to a back part of the backpack.

FIG. 1 shows a perspective view of a backpack 10, which on its side facing the back of a user or carrier of the backpack has a net element 12. Such a net element 12, also referred to as a mesh back, rests against the user's back when the user is carrying the backpack 10 on the back, and shoulder straps 14, 16 of the backpack 10 extend over the user's shoulders. A stowage space 18 (see FIG. 2) of the backpack 10 on its side facing the user's back is delimited by a back part 20.

Figure 2:
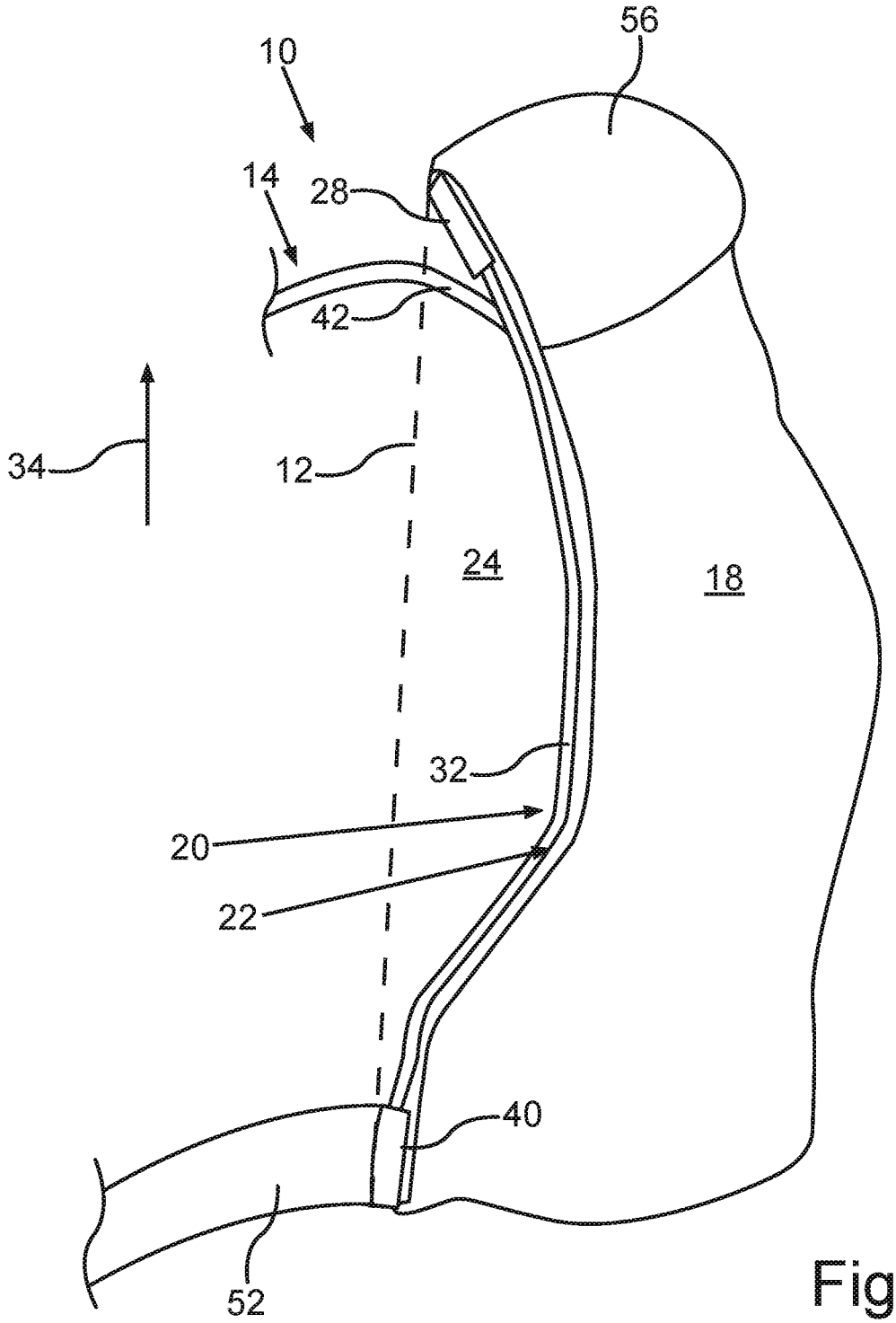
FIG. 2 schematically shows the backpack according to FIG. 1 in a side view.
Figure 3:
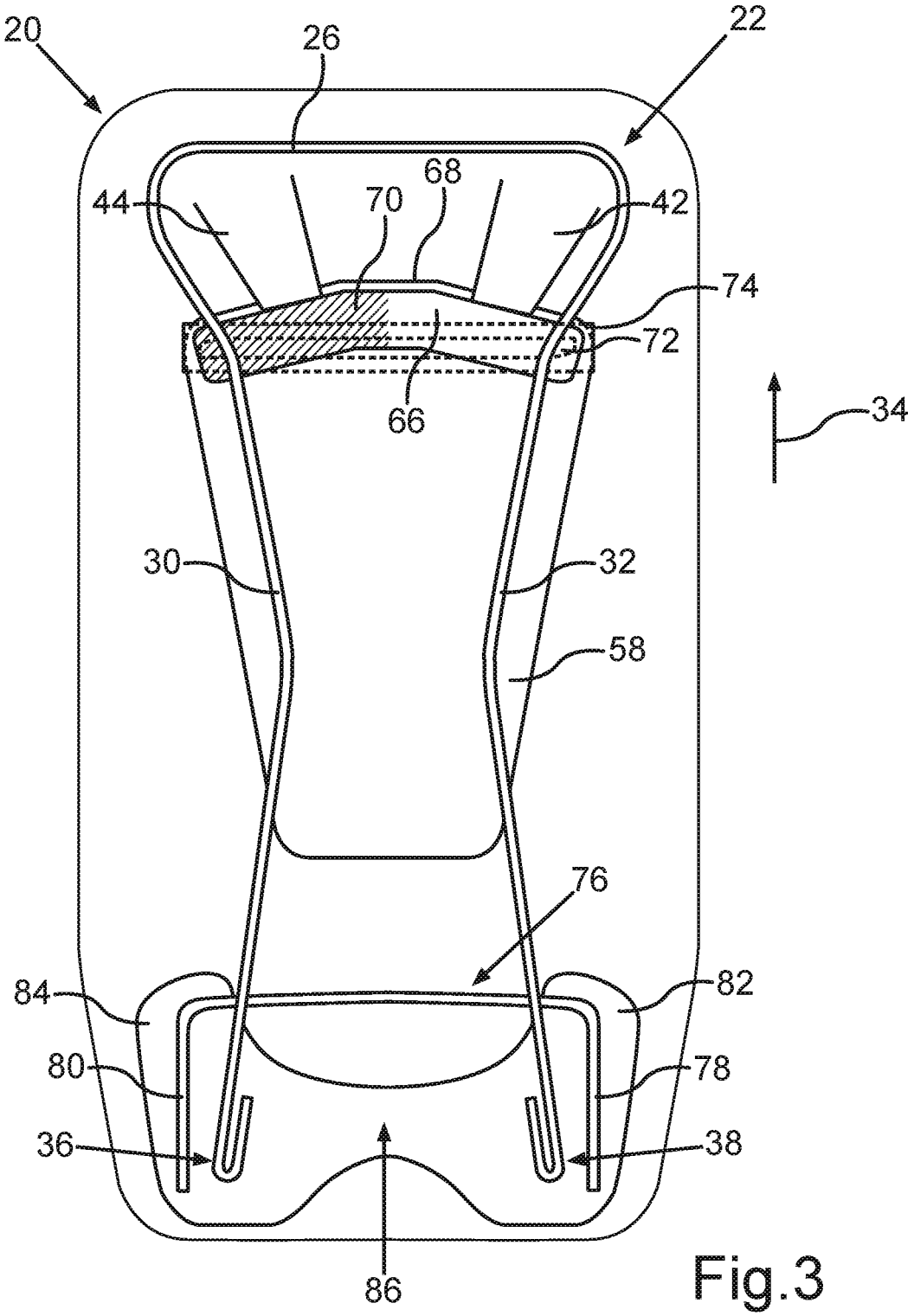
FIG. 3 schematically shows components of the back part in one embodiment of the backpack.

It is apparent from the illustration in FIG. 3 that a frame arrangement 22 is situated on the back part 20. The frame arrangement 22 is designed for tensioning the net element 12. When the net element 12 is tensioned, an intermediate space 2, clearly visible in FIG. 2, is formed between the back part 20 and the net element 12. Air can enter the intermediate space 24, since the user's back rests against the net element 12, not the back part 20. This spacing between the net element 12 and the back part 20 provides for good ventilation of the back of the user or carrier of the backpack 10 when the backpack 10 is carried strapped to the back.

It is apparent from FIG. 3 that the frame arrangement 22, which in the present case is formed by a thick bent wire and is therefore designed as a wire frame here, includes an upper transverse web 26. The frame arrangement 22 is inserted into a pocket 28 of the backpack 10 in the area of the upper transverse web 26. The pocket may be opened by means of a zipper, for example, to gain access to the frame arrangement 22 or the wire frame. The frame arrangement 22 may be removed from the backpack 10 in this way. A first leg 30 and a second leg 32 of the frame arrangement 22 extend downwardly from the upper transverse web 26, viewed in a vertical direction 34 of the backpack 10. The second leg 32 is schematically shown in the side view in FIG. 2.

A free end 36 (see FIG. 3) of the first leg 30 is inserted into an insert pocket that is formed on the back part 20. Analogously, a free end 38 (see FIG. 3) of the second leg 32 is inserted into an insert pocket 40, schematically shown in FIG. 2. The insertion of the free ends 36, 38 of the frame arrangement 22 into the lower insert pockets, of which only the insert pocket 40 is shown, and the insertion of the upper area of the frame arrangement 22 into the upper pocket 28 result in tensioning of the net element 12, and thus, formation of the intermediate space 24 (see FIG. 2).

In the present case, end areas 42, 44 of the shoulder straps 14, 16 are fastened to the back part 20. As a result, the end areas 42, 44 cross the intermediate space 24 that is formed between the net element 12 and the back part 20 (see FIG. 2). This ensures that a space is present between the net element 12 and the back part 20, also in the area of the shoulder straps 14, 16. This provides for improved ventilation of the back of the user of the backpack 10. In addition, deformation of the net element 12 is avoided, which may occur when the shoulder straps 14, 16 are fastened to the net element 12.

The end areas 42, 44 of the shoulder straps 14, 16 in the present case extend through the intermediate space 24, slightly below an area of the backpack 10 in which the back part 20 and the net element 12 come together or converge at their respective upper end (see FIG. 2). In addition, it is apparent from FIG. 1 that the end areas 42, 44 of the shoulder straps 14, 16 are guided through two passages 46 that are formed in the net element 12. Accordingly, the net element 12 is particularly wide at the level of the end areas 42, 44 of the shoulder straps 14, 16. In addition, a respective partial area 48, 50 of the net element 12 to the side of the end area 42, 44, viewed in the transverse direction of the backpack 10, is offset toward an outer side of the backpack 10.

It is apparent from FIGS. 1 and 2 that the net element 12 and the back part 20 converge toward one another at the level of hip belts 52, 54, which on their surface facing the user's back or hips are provided with an air-permeable material. In alternative embodiments of the backpack 10, instead of the hip belts 52, 54 only short hip flaps or the like may be provided, or the hip belts 52, 54 or hip flaps may be dispensed with altogether. It is also apparent from FIG. 2 that the stowage space 18 may be closed on the top side by means of a cover part 56 of the backpack 10.

The design of the back part 20 and the fastening of the end areas 42, 44 of the shoulder straps 14, 16 to the back part 20 is explained with reference to FIG. 3. The back part 20 includes a first, comparatively large-surface plate element 58 that may be designed, for example, as a plastic plate made in particular of polyethylene (PE). The first plate element 58 is situated in a fabric element 60 designed in the manner of a covering, which is visible through the net element 12 in FIG. 1. This fabric element 60, into which the first plate element 58 is sewn, includes two tunnels 62, 64 (see FIG. 1) that are used to attach the first plate element 58 to the frame arrangement 22. Accordingly, the first leg 30 is guided through the tunnel 64, and the second leg 32 is guided through the tunnel 62, the tunnels 62, 64 preferably being tensioned toward the center of the back part 20. In the present case the legs 30, 32 support the first plate element 58 on its side facing the net element 12.

The back part 20 includes a second plate element 66, which in particular is likewise designed as a plastic plate made of polyethylene (PE), for example, and which in the present case is slightly arched. Accordingly, the second plate element 66 essentially follows the course of an upper edge 68 of the first plate element 58. The end areas 42, 44 of the shoulder straps 14, 16 are fastened to the back part 20 in the area of the second plate element 66. In particular the end areas 42, 44 of the shoulder straps 14, 16 may be placed on the back part 20 at respective attachment points which, viewed perpendicularly with respect to the plane of the first plate element 58, are provided between the first plate element 58 and the second plate element 66. The slightly arched second plate element 66 is covered by a fabric element 70, which in the present case is sewn to the fabric element 60.

Due to providing the second plate element 66 in the upper area of the first plate element 58, the back part 20 is well reinforced and particularly robust in the fastening area of the shoulder straps 14, 16. However, good flexibility is still imparted to the back part 20, which makes it particularly easy to bring the back part 20 into the arched shape shown in FIG. 2 in which the net element 12 is tensioned.

The two legs 30, 32 extend past the fabric element 70 on the front side, i.e., on a side facing the user's back; the second plate element 66 is covered by the fabric element. In the variant of the backpack 10 shown in FIG. 3, an upper crossmember 72 is situated on a side of the first plate element 58 facing away from the frame arrangement 22, at the level of the second plate element 66. In this variant, the upper crossmember 72 is overlaid with a fabric element 74, which forms a tunnel.

In the variant of the backpack 10 shown in FIG. 3, a U-shaped bracket 76 is situated in a lower partial area of the frame arrangement 22. Downwardly pointing legs 78, 80 of the bracket 76 lie in the area of wings 82, 84 of a third plate element 86, which is spaced apart from the first plate element 58 in the vertical direction 34 of the backpack 10. In the present case, the third plate element 86 is likewise designed as a plastic plate and in particular is made of polyethylene (PE).

Free ends of the legs 78, 80 of the bracket 76 are inserted into insert pockets (not shown here) of the back part 20. These insert pockets, viewed in the transverse direction of the backpack 10, are spaced farther apart from one another than the insert pockets 40 into which the free ends 36, 38 of the legs 30, 32 of the frame arrangement 22 are inserted.

The lower bracket 76 and the third plate or the third plate element 86 are provided in the backpack 10 shown in FIG. 1; however, these additional reinforcement elements of the back part 20 are optional. It is also possible for the back part 20 to have the third plate element 86, but not to be provided with the bracket 76.

Figure 4:
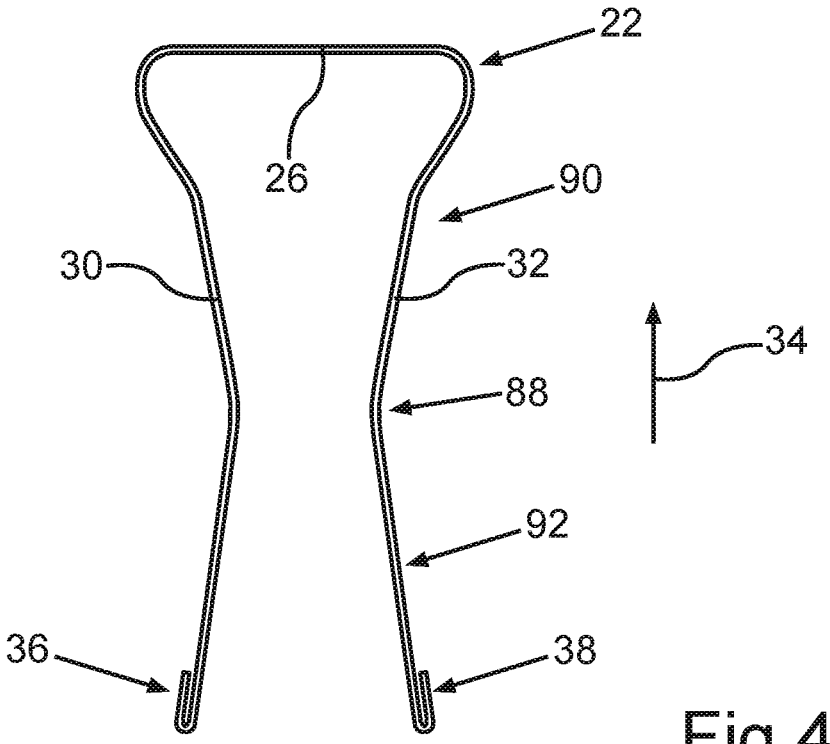
FIG. 4 shows the frame arrangement that tensions the net element in one variant of the backpack.

The upper crossmember 72 also does not have to be provided. Accordingly, only the frame arrangement 22 is shown in FIG. 4, without the additional reinforcement parts that extend in the transverse direction of the backpack, such as the crossmember 72, the bracket 76, and the third plate element 86, being present in the backpack 10. Thus, in one variant the backpack 10 may have only the back part 20 with the two plate elements 58, 66, and the frame arrangement 22 shown in FIG. 4.

However, the configuration of the frame arrangement 22 may be described well with reference to FIG. 4. Thus, in a first area 88 the two legs 30, 32 have a minimum distance from one another. Toward the upper transverse web 26, this first area 88 is adjoined by a second area 90 in which the distance between the two legs 30, 32 becomes increasingly larger. As is apparent with reference to FIG. 6, however, in the second area 90 the distance between the two legs 30, 32 may also be constant. In a third area 92 which adjoins the first area 88 toward the free ends 36, 38, the distance between the legs 30, 32 once again becomes increasingly larger.

Figure 5:
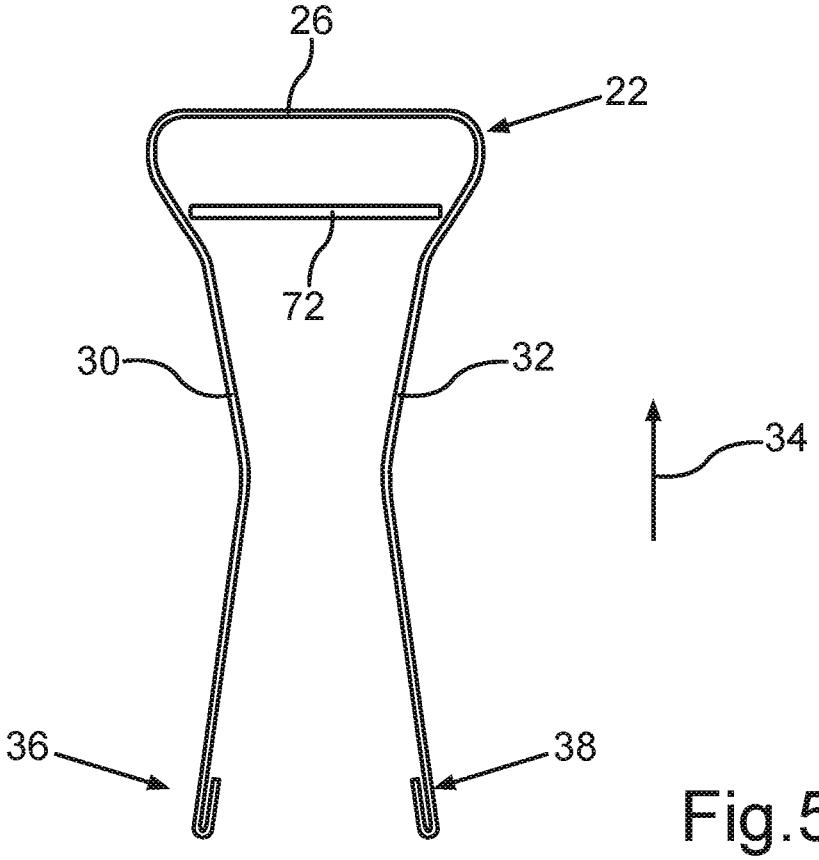
FIG. 5 shows the frame arrangement that tensions the net element in another variant of the backpack.

FIG. 5 shows a configuration of the frame arrangement 22 corresponding to the configuration of the frame arrangement 22 shown in FIG. 4. However, the back part 20 of the backpack 10, which has the frame arrangement 22 shown in FIG. 5, additionally has the upper crossmember 72 shown in FIG. 3. However, in contrast to the embodiment of the back part 20 according to FIG. 3, neither the bracket 76 (see FIG. 3) nor the third plate element 86 (see FIG. 3) is provided in the lower area of the back part 20.

Figure 6:
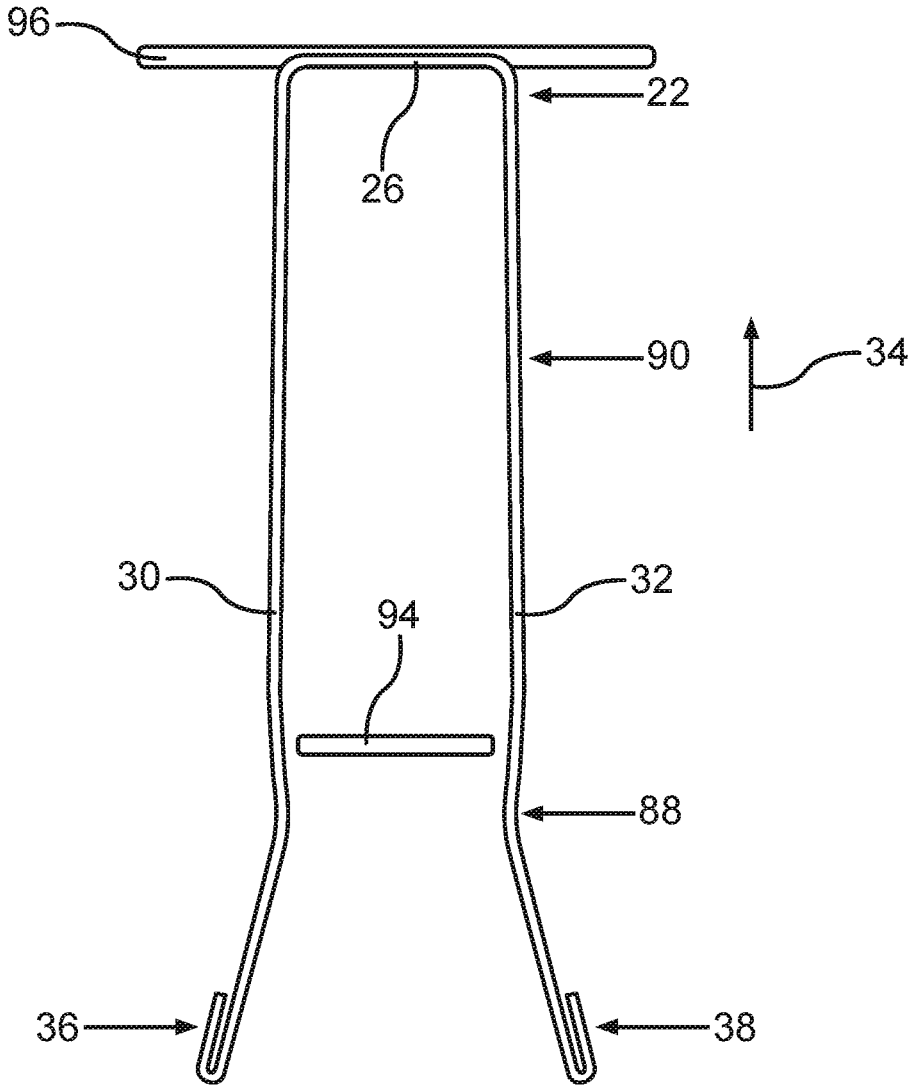
FIG. 6 shows the frame arrangement that tensions the net element in another variant of the backpack.

In the back part 20 in another variant of the backpack 10, whose frame arrangement 22 is shown in FIG. 6, a crossmember 94 is provided in the lower partial area of the frame arrangement 22. The crossmember 94 here is situated at a transition from the first area 88 to the second area 90, in which the distance between the two legs 30, 32 is constant. For this purpose, for the back part 20 which has been brought into the arched shape by the frame arrangement 22 shown in FIG. 6, neither the U-shaped bracket 76 nor the third plate element 86 is provided (see FIG. 3).

However, the back part 20 has a further crossmember 96 in the area of the upper transverse web 26 of the frame arrangement 22. A length of the crossmember 96 may be greater than the distance between the free ends 36, 38 of the frame arrangement 22.

Furthermore, for the back part 20 of the backpack 10 having the frame arrangement 22 shown in FIG. 6, adjustability of the height of the shoulder straps 14, 16 may be provided. In particular, in the second area 90 in which the distance between the legs 30, 32 is constant, the shoulder straps 14, 16 may have a displaceable design along the frame arrangement 22 in the vertical direction 34 of the backpack 10.

What is claimed is:

1. A backpack comprising a stowage space delimited by a back part on a side of the stowage space facing the back of a user of the backpack, a first plate secured to the back part, a second plate secured to the first plate, such that the first plate is positioned between the second plate and the back part, a frame arrangement secured to the back part, a net element having an upper end and a lower end, wherein both the upper end and the lower end are affixed to the back part, wherein the frame arrangement is configured for tensioning the net element such that an intermediate space is formed between the back part and the net element when the net element is tensioned, and a first shoulder strap and a second shoulder strap for carrying the backpack on the user's back, each shoulder strap including a top end secured between the first plate and the second plate, and a bottom end secured to the back part.

2. The backpack according to claim 1, further comprising a horizontal arm, and wherein the frame arrangement includes a first leg extending in a vertical direction of the backpack and a second leg extending in the vertical direction of the backpack, the legs connected by the horizontal arm.

3. The backpack according to claim 2, further comprising a first fabric element fastened to the back part and covering the first plate.

4. The backpack according to claim 3, further comprising a second fabric element fastened to the first fabric element and covering the second plate.

5. The backpack according to claim 3, wherein the first fabric element includes at least one retaining element, the at least one retaining element configured to hold at least a portion of the frame arrangement.

6. The backpack according to claim 5, wherein the at least one retaining element comprises at least one tunnel.

7. The backpack according to claim 6, wherein the at least one tunnel includes a first tunnel and a second tunnel, wherein the first leg of the frame arrangement is disposed through the first tunnel, and the second leg of the frame arrangement is disposed through the second tunnel.

8. The backpack according to claim 2, wherein the frame arrangement comprises a lower partial area, and along the vertical direction of the backpack, the back part includes a crossmember and/or a U-shaped bracket and/or a third plate.

9. The backpack according to claim 8, wherein the U-shaped bracket includes two legs that are spaced a wider distance apart than the legs of the frame arrangement and wherein the legs of the U-shaped bracket are inserted into at least one insert pocket located on the back part of the backpack.

10. The backpack according to claim 9, wherein the legs of the frame arrangement are inserted into the at least one insert pocket located on the back part of the backpack.

11. The backpack according to claim 3, wherein the legs of the frame arrangement include first ends, a first leg distance defined by the distance between the first ends, second ends disposed vertically opposite on the legs from the first ends, a second leg distance defined by the distance between the second ends, and a minimum leg distance disposed between the first ends and the second ends and having a distance that is less than each of the first leg distance and the second leg distance.

12. The backpack according to claim 11, wherein the first plate includes a width, and wherein the minimum leg distance is less than the width of the first plate.

13. The backpack according to claim 1, further comprising a plurality of respective attachment points between the first plate and the second plate for securing the top ends of the shoulder straps.

14. The backpack according to claim 1, further comprising a crossmember disposed on the first plate.

15. The backpack according to claim 1, wherein the net element includes a first passage and a second passage, and wherein the first shoulder strap is disposed through the first passage and the second shoulder strap is disposed through the second passage.

16. The backpack according to claim 1, wherein the second plate is arched.

17. The backpack according to claim 1, wherein each of the first plate and the second plate have a width and a height, and wherein the width and the height of the first plate is greater than the width and the height of the second plate.

18. The backpack according to claim 17, wherein the first plate includes an upper area secured to the second plate.

19. The backpack according to claim 1, wherein the first plate and the second plate are comprised of polyethylene.

20. The backpack according to claim 1, further comprising a hip belt disposed on the back part.

* * * * *